United States Patent [19]

Scribner

[11] Patent Number: 4,945,937

[45] Date of Patent: Aug. 7, 1990

[54] USE OF ULTRASONIC ENERGY IN THE TRANSFER OF WAXY CRUDE OIL

[75] Inventor: Michael E. Scribner, Ponca City, Okla.

[73] Assignee: Conoco Inc., Ponca City, Okla.

[21] Appl. No.: 418,013

[22] Filed: Oct. 6, 1989

[51] Int. Cl.[5] ..... F17D 3/00

[52] U.S. Cl. ..... 137/13; 366/108

[58] Field of Search ..... 137/13; 366/108, 116

[56] References Cited

U.S. PATENT DOCUMENTS 3,393,144 7/1968 Button ..... 208/28
3,497,005 2/1970 Pelopsky et al. .
3,910,299 10/1975 Tackett ..... 137/13 X
4,488,816 12/1984 Vota ..... 366/116
4,697,426 10/1987 Knowles ..... 137/13 X

FOREIGN PATENT DOCUMENTS 480453 10/1970 U.S.S.R. .
197709 9/1977 U.S.S.R. .

*Primary Examiner*—Alan Cohan

[57] ABSTRACT

Ultrasonic energy is applied to a combination of waxy crude oil and solid polymeric wax crystal modifier to effect dissolution of the modifier in the crude oil, thereby reducing the gel strength of the crude oil.

10 Claims, 3 Drawing Sheets

USE OF ULTRASONIC ENERGY IN THE TRANSFER OF WAXY CRUDE OIL

BACKGROUND OF THE INVENTION

Some of the crude oils that oil companies have the occasion to pipeline contain "high" amounts (10 percent or more) of paraffin or wax. The wax will crystallize and accumulate as the temperature of the crude oil mass is lowered, thus increasing the viscosity of the crude oil and making it difficult to pump at a given rate. In addition, if the flow of crude oil is stopped for a period of time greater than approximately 12 hours, the wax crystals will form an interconnected network which will impede flow when it comes time to restart the pipeline.

The force required to break the gel and begin flow is known as the gel strength. In some cases, the gel strength may be sufficiently high as to keep the flow from restarting. In the case of a subsea pipeline, the consequences could be disastrous. Presently, offshore platforms and terminal are designed to inject chemical known as pour-point depressants or wax crystal modifiers. These compounds serve to inhibit the interconnection of the wax crystals keeping the gel strength below the force needed to initiate flow of the pipeline. In many instances the cost of the treatment package is a major fraction of the cost of production.

The wax crystal modifiers used in waxy crude oils are solid materials which are marginally soluble in hydrocarbon fractions, particularly crude oils. They are more soluble in lighter hydrocarbon fractions, but even then may constitute only a small percentage of the modifier-solvent mix. Customarily the wax modifiers are dissolved in a light hydrocarbon fraction and are then stored for use as needed. In the case of an offshore platform, the extra volume and weight of solvent-chemical mixture requires expensive storage space which must be designed into the platform. Also, the substantial amount of solvent hydrocarbon fraction required increases processing cost in the refinery where this material is recovered from the crude oil.

Ultrasonic processors are used to provide vibrational energy at very high frequencies (20,000–800,000 cycles per second). In a liquid medium, these oscillations create high shear strains which create microscopic gas pockets. These gas pockets, by collapsing and expanding, serve to enhance the shear strain to the point that weak molecular binding forces can be disrupted. For instance, biological tissues can be completely disrupted and homogenized by the application of ultrasonic energy. Ultrasonic energy has also found used in the depolymerization and viscosity control of synthetic and natural polymers. High-frequency vibration also has been utilized to enhance chemical reactions.

PRIOR ART

U.S. Pat. No. 3,497,005 to Pelopsky et al. discloses a method for breaking molecular bonds in a material by means of sonic energy. The ultrasonic energy may be used to treat organic fuel for producing lower molecular weight molecules of solid fuel which provide more caloric energy than the higher molecular weight molecules.

Russian Patent 480,453 discloses an annular ultrasonic transducer unit which can be used for flowing liquid treatment.

Russian Patent 571,657 discloses the use of heat and vibration (20–250 cycles/second) to break down paraffin in petroleum.

THE INVENTION

According to the present invention a solid polymeric wax crystal modifier is combined with flowing waxy crude oil and the combined material is subjected to ultrasonic energy, whereby a sufficient amount of modifier is dissolved in the crude oil to lower the viscosity and the gel strength thereof.

DETAILED DESCRIPTION OF THE INVENTION

Figure 1:
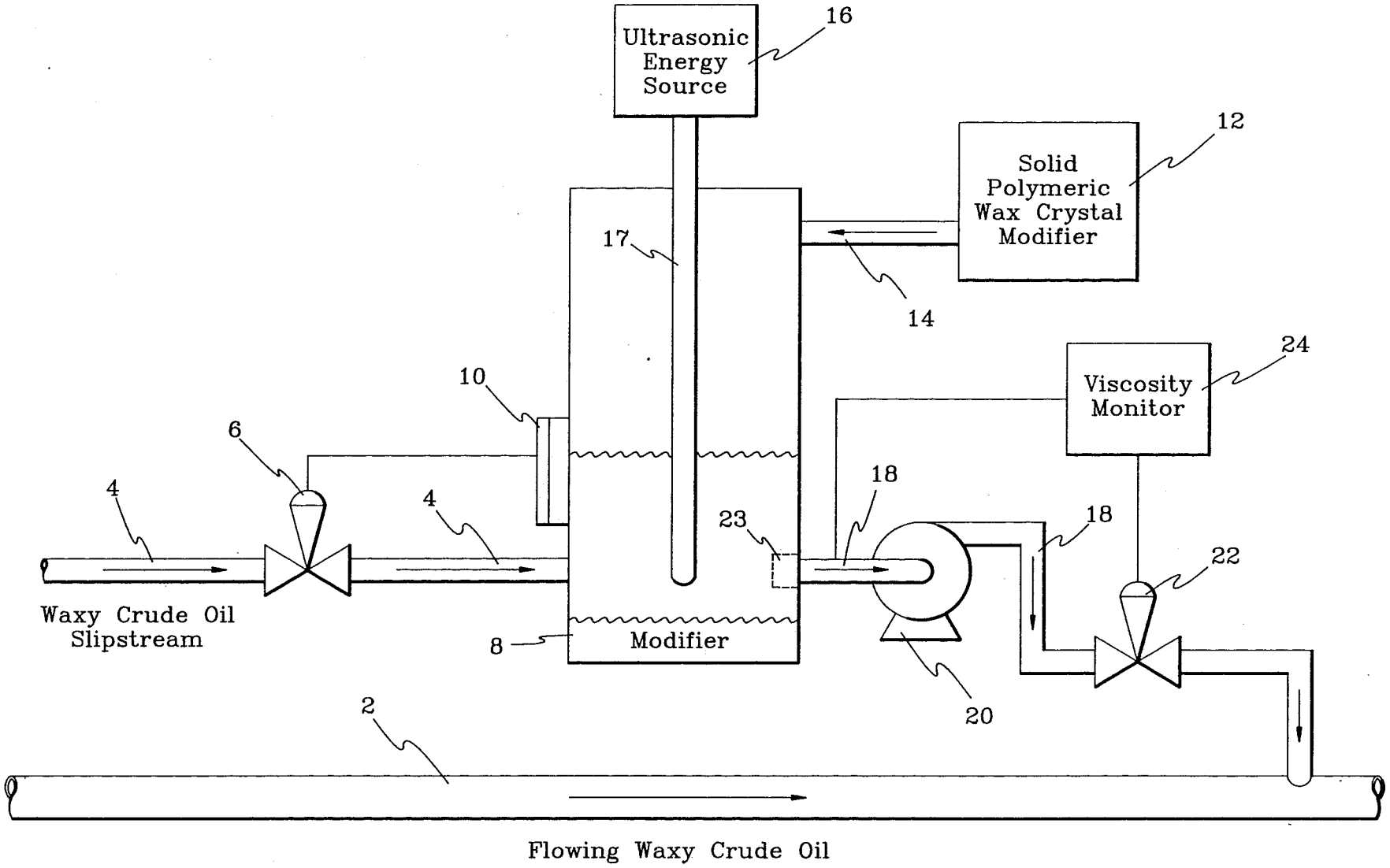
FIGS. 1, 2 and 3 are schematic representations of process and apparatus arrangements for carrying out the invention.

The invention is best described by reference to the drawings. Referring to FIG. 1, flowing waxy crude oil is passed through line 2. This may be any crude oil which is difficult to pump at ambient conditions because of its high viscosity. Such crude oils usually contain from about 5 to about 30 percent wax. Even waxy crude oils which are capable of being pumped as long as they are flowing may, if their movement is halted temporarily or over an extended period of time, become sufficiently viscous that restarting flow is extremely difficult or even impossible. Waxy crude oils are usually easy to pump if they are increased sufficiently in temperature. This invention is particularly applicable to situations where it is not feasible or economically desirable to provide enough heat to the waxy crude oil to make it readily pumpable. Also, even if heat is provided to waxy crude oil, if pumping is stopped for a substantial period of time for any reason and the crude oil is exposed to low temperatures, blockage of the flow of the crude oil may be encountered. This invention is especially applicable to the transfer of crude oil from an offshore platform by underwater pipeline to shore. The governing viscosity in the movement of crude oil in this manner is the viscosity which is obtained in the pipeline below the surfaces of the water if flow of crude oil is halted for any appreciable period of time. The invention is also applicable to the transfer of waxy crude oil between ships and also from ship to shore or from shore to a ship. While the above types of transfer are typical, the invention is applicable to any movement of waxy crude oil where a temporary or substantial cessation of flow would result in blockage of the crude oil line.

Returning now to FIG. 1, a slip stream of the waxy crude oil is introduced to vessel 8 through line 4 and control valve 6. A level of waxy crude oil is maintained in vessel 8 by level controller 10 which actuates control valve 6. While a conventional control valve is shown, any suitable means for controlling the level of crude oil in vessel 8 may be employed.

A solid polymeric wax crystal modifier i.e., pour point depressant is provided in vessel 12 and is transferred to vessel 8 through line 14. Ultrasonic energy is provided to the waxy crude oil and solid polymeric wax crystal modifier from ultrasonic energy source 16 through probe 17. Through the action of the ultrasonic energy, the difficultly soluble solid polymeric wax crystal modifier is readily dissolved in the wax crude oil slip stream.

The waxy crude oil containing dissolved wax crystal modifier is withdrawn from vessel 8 through line 18 and passed through pump 20 to the flowing waxy crude oil in line 2. The amount of solid polymeric wax crystal modifier introduced to vessel 8 and dissolved in the waxy crude oil slip stream can be regulated to provide a constant viscosity of the crude oil crystal modifier mixture leaving vessel 8 through line 18. This regulation is effected by monitoring the viscosity of this mixture and controlling the flow through control valve 22 in response to changes in such viscosity. Sufficient wax crystal modifier is introduced to the flowing wax crude oil in line 2 to assure that the main crude oil stream will remain pumpable even if flow is interrupted at a future time.

Sufficient solid polymeric wax crystal modifier is introduced to vessel 8 to maintain a source of this material in vessel 8 at all times. To prevent passage of solid polymeric wax crystal modifier from vessel 8 into pump 20 a screen or grate 23 may be provided on the suction of the pump.

The polymeric wax crystal modifiers used in the process of the invention are solids at room temperature and usually are materials of high molecular weight in the hundreds of thousands or higher. Typically, these materials may be polymers, copolymers or terpolymers; however, copolymers and terpolymers are usually preferred. Examples of solid polymeric wax crystal modifiers are terpolymers of low molecular weight olefins, such as ethylene or propylene with an alkylvinylacetate and maleic anhydride. The alkyl group in the vinyl acetate may vary from 1 to about 20 carbon atoms. Other polymers which may be used are copolymers of low molecular weight olefins and alkylvinyl acetates of similar alkyl length. Still other polymers are copolymers of $C_2$ to about $C_{20}$ alkenes and maleic anhydride.

Specific examples of polymers include terpolymers of ethylene, vinyl acetate and maleic acid; propylene, ethylvinyl acetate and maleic acid, copolymers of ethylene and vinyl acetate, octene and methyl vinyl acetate, 1-heptadecene and maleic acid, and the like. Of the olefins used in the various polymers, copolymers and terpolymers, ethylene is usually preferred because of its low cost and availability.

While viscosity is conveniently used to monitor and control the addition of the solid polymeric wax crystal modifier to the flowing crude oil, the gel strength of the resulting product, which is a function of viscosity, is the preferred property used to characterize the flowability of the crude oil and the mixture of crude oil and wax crystal modifier.

The gel strength of a mixture of crude oil and polymeric wax crystal modifier which has been subjected to ultrasonic energy is measured in a gelometer (pipe viscosimeter). This apparatus consists of a 10 inch$\times$1.065 inch jacketed pipe which allows for a circulating flow of water to regulate the temperature of the crude-wax crystal modifier mixture in the pipe. A pressure applying system is attached to the pipe via a $\frac{1}{8}$ inch teflon tubing connected to an oil/water reservoir. The pressure is applied by a constant volume motorized pump.

In carrying out the measurement, the pipe is filled with the mixture of crude oil and wax crystal modifier. A cooling program is then initiated to provide a cooling rate of 8.3° C. per hour until the temperature of the mixture in the pipe reaches 0° C. Since the mixture of crude oil and wax modifier reduces in volume during the cooling step, a stand pipe is provided on the gelometer and the initial mixture of crude and wax crystal modifier is introduced in an amount to fill at least part of the stand pipe. The temperature of the mixture is held at 0° C. for 24 hours before running the gel breaking test. At this time a drain plug in the stand pipe is removed so that the excess crude-wax crystal modifier may drain from the system. The pressure applying pump is then activated to apply pressure to the mixture in the gelometer and the pressure at which the mixture begins to move from the gelometer is determined. The gel strength is then calculated from the following formula:

$$\text{Gel Strength} = \frac{(\text{psi}) \times (\text{Gelometer Diameter}) \times (300)}{\text{Gelometer Length}}$$

The amount of solid polymeric wax crystal modifier required to effectively treat a flowing stream of waxy crude oil may be readily determined by experiment. Once the desired viscosity of the crude oil (which is a measure of the gel strength of the crude oil) has been determined, the amount of solid polymeric wax crystal modifier required to attain this viscosity may readily be introduced into the waxy crude oil slip stream, which is then combined with the main stream of crude oil. Usually the amount of solid polymeric wax crystal modifier introduced to the flowing waxy crude oil is sufficient to provide a concentration of such modifier of between about 100 and about 2000 ppm, although more modifier may be added if desired. More preferably, the amount of solid polymeric wax crystal modifier will vary from about 400 to about 600 ppm.

Although not shown in FIG. 1, it is desirable to inject the waxy crude oil slip stream containing dissolved solid polymeric wax crystal modifier into the flowing waxy crude oil upstream of the pump being used to transfer such crude oil. In this way, the slip stream and flowing waxy crude oil are thoroughly mixed under conditions of turbulent flow in their passage through the transfer pump.

Any commercially available ultrasonic energy source may be used in carrying out the invention. Such energy sources produce high frequency oscillating currents which are transmuted to supersonic waves of compression and rarification in a transmitting liquid by use of a piezo-electric quartz crystal. The theory and operation of ultrasonic energy sources has been widely described in the literature and in numerous patents. The frequency of the alternating current used in the process of the invention will ordinarily vary between about 15,000 cycles per second and about 900,000 cycles per second although higher frequencies may be used if desired. The total wattage required to impart the desired ultrasonic energy will usually be between about 0.5 and about 10 kilowatts.

Figure 2:
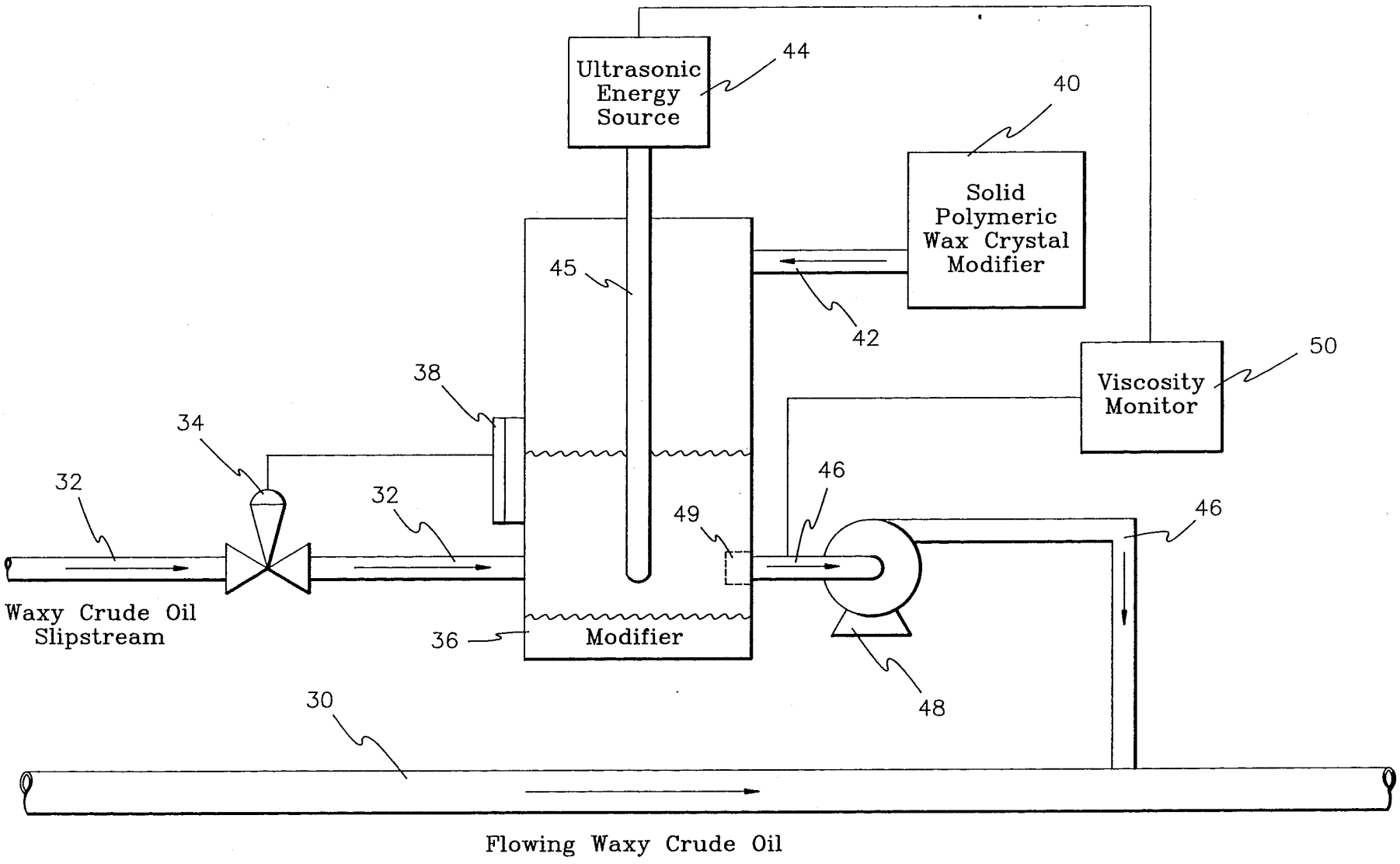

In another aspect of the invention, set forth in FIG. 2, a waxy crude oil stream is introduced through line 32 and control valve 34 to vessel 36. The level of crude oil in vessel 36 is maintained by level controller 38 which actuates control valve 34. Solid polymeric wax crystal modifier is transferred from vessel 40 through line 42 to vessel 36. Again, the amount of solid polymeric wax crystal modifier introduced to the vessel is sufficient to maintain an excess of such modifier in the bottom of the vessel. The ultrasonic energy required in this aspect of the invention is provided by energy source 44 through probe 45. The waxy crude oil slip stream containing wax crystal modifier is withdrawn from vessel 36 through a screen or grate 49 and line 46 and is introduced to the main body of flowing waxy crude oil in line 30. The viscosity of the waxy crude oil slip stream containing dissolved wax crystal modifier is monitored by viscosity monitor 50 which controls the viscosity of this stream by controlling the amount of ultrasonic energy imparted to the material in vessel 36. Here again, the viscosity and the gel strength desired in the flowing waxy crude oil n line 30 will establish the amount of solid polymer wax crystal modifier dissolved in the crude oil slip stream in vessel 36 and the magnitude of such crude oil slip stream.

Figure 3:
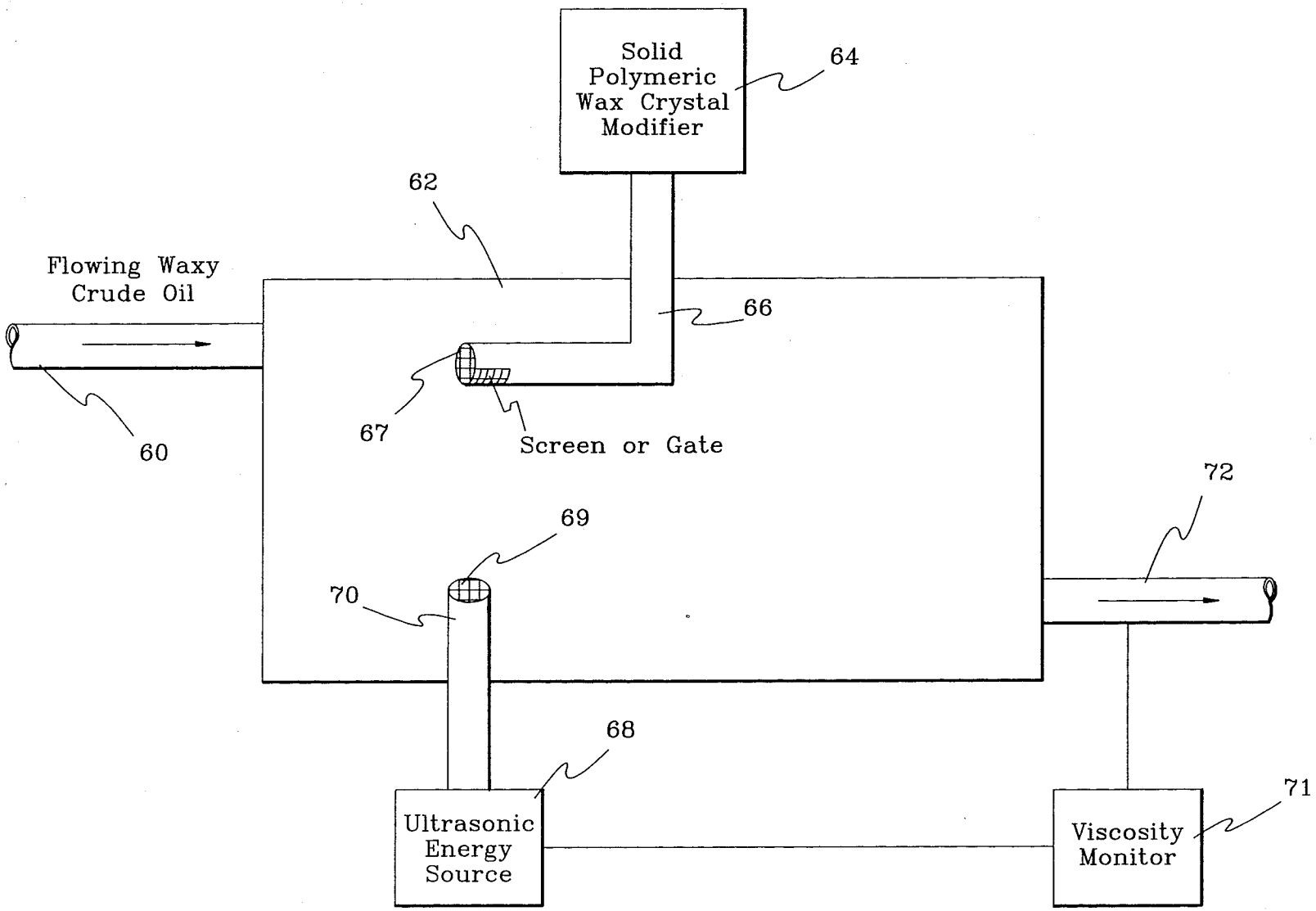

It is not necessary to the process of the invention that the solid polymeric wax crystal modifier be combined initially with a slip stream of the flowing waxy crude oil. If desired, the wax crystal modifier can be combined with the total flowing waxy crude oil being transferred in the process. This aspect of the invention is illustrated in FIG. 3 in which the flowing waxy crude oil is introduced through line 60 to an enlarged zone 62 from which it is removed through line 72. Solid polymeric wax crystal modifier is provided to enlarged zone 62 from vessel 64 through line 66. Passage of solid particles wax crystal modifier into zone 62 through the end of line 66 is prevented by a screen 67. An area of contact between the flowing waxy crude oil and wax crystal modifier is provided through this screen 67 and through the additional screen or grate shown in the drawing. Ultraonsic energy is provided in zone 62 through a source 68 and probe 70. This probe contains an opening 69 at the end thereof for transmission of ultrasonic energy into the waxy crude oil and wax crystal modifier in zone 62. The viscosity of the flowing waxy crude oil leaving zone 62 through line 72 is controlled by viscosity monitor 71 which maintains the desired viscosity by controlling the amount of ultrasonic energy imparted from source 68.

As pointed out previously, the usual method used in the past for introducing solid polymeric wax crystal modifier to a flowing waxy crude oil stream was to first combine the modifier with a solvent such as hydrocarbon distillate. Usually, available refinery streams were used for this purpose although other hydrocarbon solvents such as toluene or xylene could be used. On a weight basis, the amount of solvent employed was up to 10 times as much or more than the weight of solid polymeric material which was used. This solvent had to be transported to the point at which it was combined with the waxy crystal modifier. In the case of a transfer of waxy crude oil from an offshore platform, the solvent and wax crystal modifier had to be transported to the platform and stored in some type of container until required for use. The process of the invention eliminates such storage, which is expensive in terms of platform storage cost and also the cost of the solvent which is not required in practicing the process of the invention.

The following examples are presented in illustration of the invention:

EXAMPLE 1

The test is carried out in apparatus as shown in FIG. 1 of the drawings. The total crude oil used in the test is 20,000 bbls/day or 833 bbls/hr. A slip stream of 1.67 bbls/hr of the crude which contains 12 percent wax is introduced to vessel 8 which contains solid GELSTOP 78® wax crystal modifier, a terpolymer of ethylene, vinylacetate and carbon monoxide manufactured by Conoco Inc. Sufficient GELSTOP is provided so that 200 ppm of this material (based on the total crude oil) is available for combination with the crude oil slip stream. An ultrasonic sound source, VIBRA CELL TM manufactured by Sonics and Materials, Inc. which provides ultrasonic sound at a frequency of 20000 cycles per second with a power input of 2 KW is provided in vessel 8. The energy provided by this source is sufficient to dissolve the desired amount of GELSTOP in the crude oil slip stream.

The crude oil effluent containing GELSTOP is removed from vessel 8 and combined with the main crude oil stream. Measurement of this stream shows a gel strength of 40 lb force/100 $ft^2$.

EXAMPLE 2

In a run similar to that carried out in Example 1 the GELSTOP is added to the total crude oil stream rather than to a slipstream. The gel strength obtained using this procedure is similar to that which is obtained in Example 1.

EXAMPLE 3

Two other runs are carried out under the same conditions as in Example 1, but without the use of ultrasonic sound, and provide a crude oil product of much higher gel strength. In one run with solid GELSTOP the gel strength of the mixture of crude oil and GELSTOP is 175. In another run where the GELSTOP is introduced to the crude oil in a light hydrocarbon solution the gel strength of the crude oil and GELSTOP is 72.

It is apparent that the process of the invention provides a product of substantially lower gel strength.

While certain embodiments and details have been shown for the purpose of illustrating the present invention, it will be apparent to those skilled in this art that various changes and modifications may be made herein without departing from the spirit or scope of the invention.

I claim:

1. In a process for flowing waxy crude oil through a pipeline, the improvement which comprises:
   (a) combining at least a portion of the flowing crude oil with a solid polymeric wax crystal modifier;
   (b) applying ultrasonic energy to the combined crude oil and modifier whereby a sufficient amount of said modifier is dissolved in said crude oil to lower the gel strength thereof.

2. The process of claim 1 in which the modifier is contained in an enlarged section of said pipeline.

3. The process of claim 2 in which the viscosity of the combined crude oil and modifier after application of sonic energy thereto is monitored and the amount of sonic energy applied is controlled in response to said measured viscosity, thereby controlling the concentration of modifier in the crude oil.

4. The process of claim 1 in which a slip stream of said crude oil is combined with said modifier and the resulting slip stream plus modifier is combined with the remainder of the crude oil.

5. The process of claim 4 in which the viscosity of the crude slip stream plus modifier after application of sonic energy is monitored and the amount of sonic energy applied thereto is controlled in response to said measured viscosity, thereby controlling the concentration of modifier in said slip stream.

6. The process of claim 4 in which the viscosity of the crude slip stream plus modifier after application of sonic energy is monitored and the amount of crude oil in said slip stream is controlled in response to said measured viscosity, thereby controlling the concentration of modifier in said slip stream.

7. The process of claim 1 being carried out on an offshore platform.

8. The process of claim 1 being carried out in a ship to ship transfer of crude oil.

9. The process of claim 1 being carried out in a transfer of crude oil between ship and shore.

10. The process of claim 1 in which the solid polymeric wax crystal modifier is a terpolymer of ethylene, vinyl acetate and maleic acid.

* * * * *